US006400271B1

(12) United States Patent
Davies, Jr. et al.

(10) Patent No.: US 6,400,271 B1
(45) Date of Patent: Jun. 4, 2002

(54) ACTIVATE/DEACTIVEABLE SECURITY TAG WITH ENHANCED ELECTRONIC PROTECTION FOR USE WITH AN ELECTRONIC SECURITY SYSTEM

(75) Inventors: John Edwin Davies, Jr., Sewell, NJ (US); Lawrence Appalucci, Villanova, PA (US); Alan Paul Dutcher, West Deptford, NJ (US); Gary Thomas Mazoki, Sewell, NJ (US); Anthony Frank Piccoli, Audubon, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days.

(21) Appl. No.: 09/528,637

(22) Filed: Mar. 20, 2000

(51) Int. Cl.[7] ..... G08B 13/14

(52) U.S. Cl. ..... 340/572.1; 340/572.2; 340/572.3

(58) Field of Search ..... 340/572.1, 572.3, 340/572.8, 572.2, 551

(56) References Cited

U.S. PATENT DOCUMENTS 3,810,147 A * 5/1974 Cichtblau ..... 340/572.3
5,103,210 A 4/1992 Rode et al.
5,182,544 A 1/1993 Aquilera et al.
5,241,298 A * 8/1993 Lian et al. ..... 340/572
5,367,290 A * 11/1994 Kind et al. ..... 340/572.3
5,517,179 A * 5/1996 Charlot, Jr. ..... 340/572.2
5,517,195 A * 5/1996 Narlow et al. ..... 340/572.3
5,754,110 A 5/1998 Appalucci et al.
5,841,350 A 11/1998 Appalucci et al.
6,169,482 B1 * 1/2001 Altwasser et al. ..... 340/572.3

* cited by examiner

*Primary Examiner*—John Tweel
(74) *Attorney, Agent, or Firm*—Akin, Gump, Strauss, Hauer & Feld, L.L.P.

(57) ABSTRACT

A security tag for use with an electronic security system which functions within a second frequency range comprises a substantially planar dielectric substrate having first and second sides. A first conductive pattern is provided on the first side of the substrate, the first conductive pattern comprising at least a first inductive element, a first plate of a first capacitive element and a first plate of a second capacitive element. A second conductive pattern located on the second side of the substrate comprises at least a second inductive element, a second plate of the first capacitive element and a second plate of a second capacitive element with the plates of the capacitive elements being generally aligned. The inductive elements and the capacitive elements form a resonant circuit which resonates at a first frequency within a first frequency range which is outside of the second frequency range. A direct electrical connection extends through the substrate to electrically connect the first conductive pattern to the second conductive pattern to thereby continuously maintain both sides of the substrate at substantially same static charge level.

12 Claims, 4 Drawing Sheets

ACTIVATE/DEACTIVEABLE SECURITY TAG WITH ENHANCED ELECTRONIC PROTECTION FOR USE WITH AN ELECTRONIC SECURITY SYSTEM

BACKGROUND OF THE INVENTION

The present invention relates generally to activatable and deactivatable security tags, of the type used with an electronic surveillance system for detecting the unauthorized removable of articles and, more particularly, two such security tags which include enhanced electrostatic protection.

The use of electronic article surveillance or security (EAS) systems for detecting and preventing theft or unauthorized removal of articles or goods from retail establishments and/or other facilities, such as libraries, has become widespread. In general, radio frequency type EAS systems utilize a label or security tag containing an electronic circuit such as an inductor/capacitor resonant circuit, which is secured to an article or the packaging for an article to be protected. A transmitter tuned to the frequency of the resonant circuit of the security tag (the detection frequency) is employed for transmitting electromagnetic energy into a surveillance or detection zone typically located proximate to the exit of a retail establishment or other facility. A receiver, also tuned to the resonant frequency of the security tag, is also located proximate to the surveillance zone. If an article containing an active security tag enters the detection zone, the resonant circuit of the tag resonates, establishing a disturbance in the electromagnetic field which is detected by the receiver to activate an alarm for alerting security personnel.

In order to prevent accidental activation of an alarm by a person who has actually purchased an article having a security tag or a person who is authorized to remove from a facility an article having a security tag, security tags must be deactivatable. One method for deactivating a security tag involves momentarily placing the tag near a deactivation device which subjects the tag to electromagnetic energy at the resonant frequency of the tag and at a power level sufficient to cause the resonant circuit to short circuit and, therefore not resonate at the detection frequency. In order to avoid having the deactivation electromagnetic energy at a high power level, deactivatable security tags typically have a deactivation feature, such as one or more capacitor elements in which the dielectric between, at least a portion of the plates of the capacitor elements is weakened or reduced so that the capacitor plates can be short circuited when exposed to electromagnetic energy at the resonant frequency at relatively low power levels. Other, more recently developed security tags are both activatable and deactivatable. Activatable/deactivatable security tags typically have a resonant circuit having at lease two capacitors, each of which includes a weakened or reduced dielectric area between the capacitor plates to facilitate short circuiting of the capacitors. The resonant circuit of an activatable/deactivatable tag typically has an initial resonant frequency, which is generally outside of the frequency range of the EAS system with which the tag is to be used. When the tag is exposed to a sufficient level of electromagnetic energy at the initial resonant frequency, one of the capacitors becomes short circuited, thereby shifting the resonant frequency of the security tag to a frequency which is within the detection frequency range of the EAS system, i.e., the tag is activated.

The security tag may thereafter be deactivated by exposing the resonant circuit to a sufficient level of electromagnetic energy at the new resonant frequency to short circuit the second capacitor, thereby, either preventing the resonant circuit from resonating at all or shifting the frequency of the resonant circuit to be outside of the frequency range of the EAS system, i.e., deactivating the tag. The structure and operation of an activatable/deactivatable tag of this type is described in U.S. Pat. No. 5,081,445, entitled "Method For Tagging Articles Used In Conjunction With An Electronic Article Surveillance System And Tags Or Labels In Conjunction Therewith" and in U.S. Pat. No. 5,103,210, entitled "Activatable/Deactivatable Security Tag For Use With An Electronic Security System", both of which are incorporated herein by reference.

While activatable/deactivatable security tags of the type disclosed in the above-identified patents have been shown to be very effective when utilized with EAS systems, they have been found to suffer from certain drawbacks. Security tags of this type are typically formed of a flexible, substantially planar dielectric substrate having a first conductive pattern on a first side and a second conductive pattern on a second side, the conductive patterns together establishing the resonant circuit with the substrate forming the dielectric between the plates of the capacitor(s). There is no direct electrical connection between the conductive patterns. Under certain environmental conditions, an electrostatic build-up may occur on either or both sides of the substrate. In some cases, particularly when the electrostatic charge on one side of the substrate is abruptly reduced or drained, such as when one side of the substrate is grounded to create electrostatic discharge, the voltage potential on one side of the substrate is sufficiently different from the voltage potential on the other side of the substrate to cause premature breakdown of the dielectric between the plates of one or more of the capacitors, thereby prematurely short circuiting one or more of the capacitors and either prematurely activating the security tag (in the case of the activatable/deactivatable tag) or prematurely deactivating the security tag.

One solution to the above-described electrostatic discharge problem is disclosed in U.S. Pat. No. 5,182,544, entitled "Security Tag With Electrostatic Protection", the subject which is hereby incorporated herein by reference. The security tag of the '544 patent includes a static dissipation member on each side of the substrate, which effectively surrounds the two conductive patterns and temporarily maintains both sides of the substrate at substantially the same electrostatic potential during the manufacturing process. A frangible connection is provided between at least one of the conductive patterns and the surrounding static dissipation member, the frangible connection being broken when the tag is removed from its carrier for placement on an article. The breaking of the frangible connection effectively disables the electrostatic protection afforded by the static dissipation member. While the electrostatic protection methods described in U.S. Pat. No. 5,182,544 are very effective for preventing premature breakdown of the dielectric between the capacitor plates while the tag is in web form, i.e., before placement on an article, it provides no electrostatic protection once the tag is placed on an article to be protected.

A further alternative for providing electrostatic protection is taught by U.S. Pat. No. 5,754,110, entitled "Security Tag And Manufacturing Method" the subject matter which is incorporated herein by reference. The '110 patent teaches the concept of a discontinuous guard member which surrounds the conductive pattern on one or both sides of the substrate. However, because the guard member on the first side of the substrate is not electrically connected to the guard member on the second side of the substrate, the method disclosed in this patent is not completely effective in preventing the discharge of the electrostatic buildup which results in premature short circuiting of one of the capacitors.

The present invention comprises a security tag, which overcomes the above-described problems associate with the prior art by providing a direct electrical connection through the dielectric substrate of a tag to permanently electrically connect together a first conductive pattern on a first side of the substrate and a second conductive pattern on the second side of the substrate to thereby continuously maintain both sides of the substrate at substantially the same static charge level at all times. With a tag made in accordance with the present invention, if the electrostatic charge level on a first side of the substrate is abruptly diminished, for example, by one side of the tag being grounded, the charge level on the second side of the substrate will be likewise diminished, thereby decreasing the potential for a difference in the static charge levels on opposite side of the substrate, and thereby preventing premature short circuiting of any of the capacitors.

BRIEF SUMMARY OF THE INVENTION

Briefly stated, the present invention, in one embodiment, comprises a security tag for use with an electronic security system which functions within a second frequency range. The tag comprises a substantially planar dielectric substrate having a first side and a second side. A first conductive pattern is located on the first side of the substrate, the first conductive pattern comprising at least a first inductive element, a second inductive element, a first plate of a first capacitive element and a first plate of a second capacitive element. A second conductive pattern is located on the second side of the substrate, the second conductive pattern comprising at least a second plate of the first capacitive element and a second plate of the second capacitive element, the plates of each of the capacitive elements being aligned with the inductive elements and the capacitive elements forming a resonant circuit which resonates at a first frequency within a first frequency range which is outside of the second frequency range. A direct electrical connection extends through the substrate to electrically connect the first conductive pattern to the second conductive pattern to thereby continuously maintain both sides of the substrate at substantially the same static charge level.

In a second embodiment, the present invention comprises a security tag for use with an electronic security system which functions within a second frequency range. The tag comprises a substantially planar dielectric substrate having a first side and a second side. A first conductive pattern is located on the first side of the substrate, the first conductive pattern comprising at least a first inductive element, a first plate of a first capacitive element, and a first plate of a second capacitive element. A second conductive pattern is located on the second side substrate, the second conductive pattern comprising at least a second inductive element, a second plate of the first capacitive element and a second plate of the second capacitive element with the plates of each of the capacitive elements being generally aligned. The inductive elements and the capacitive elements together form a resonant circuit which resonates at a first frequency within a first frequency range which is outside of the second frequency range. A direct electrical connections extends through the substrate to electrically connect the first conductive pattern to the second conductive pattern to thereby continuously maintain both sides of the substrate at substantially the same static charge level.

In a third embodiment, the present invention comprises a security tag for use with electronic security system which functions within a second frequency range. The tag comprises a substantially planar dielectric substrate having a first side and a second side. A first conductive pattern is located on the first side of the substrate, the first conductive pattern comprising at least a first inductive element, a second inductive element, a first plate of a first capacitive element and a first plate of a second capacitive element. A second conductive pattern is located on the second side of the substrate, the second conductive pattern comprising at least a third inductive element, a fourth inductive element, a second plate of the first capacitive element and second plate of the second capacitive element, the plates of each of the capacitive elements being generally aligned. The inductive elements and capacitive elements form a resonant circuit which resonates at a first frequency within a first frequency range which is outside of the second frequency range. A direct electrical connection extends through the substrate to electrically connect the first conductive pattern to the second conductive pattern to thereby continuously maintain both sides of the substrate at substantially the same static charge level.

BRIEF DESCRIPTION OF THE SEVERAL VIEWS OF THE DRAWINGS

The foregoing summary, as well as the following detailed description of preferred embodiments of the invention will be better understood when read in conjunction with the appended drawings. For the purpose of illustrating the invention, there are shown in the drawings, embodiments which are presently preferred. It should be understood, however, that the present invention is not limited to the precise arrangements and instrumentality shown. In the drawings.

DETAILED DESCRIPTION OF THE INVENTION

Figure 1:
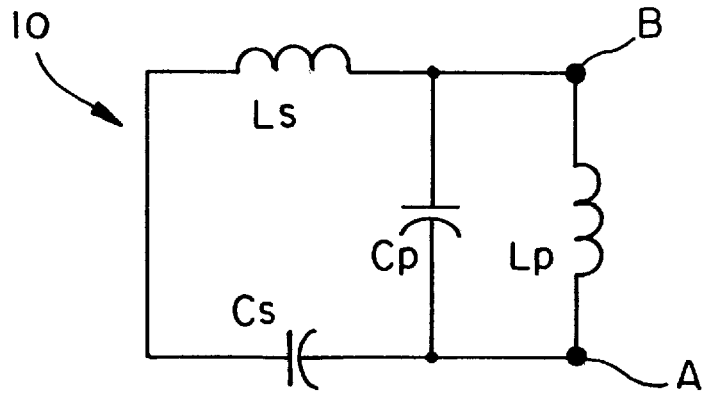
FIG. 1 is an electrical schematic of a resonant circuit in accordance with a preferred embodiment of the present invention.

Referring to the drawings, wherein the same reference numerals are used to designate the same components throughout the several figures, there is shown in FIG. 1 an electrical schematic representation of a resonant circuit 10 in accordance with a first preferred embodiment of the present invention. The resonant circuit 10 includes four components namely, a first inductive element or inductance Lp, a second inductive element or inductance Ls, a first capacitive element or capacitance Cp and a second capacitive element or capacitance Cs. Additional inductive or capacitive elements or components may be added if desired. As shown in FIG. 1 the second inductance Ls is connected in series with the second capacitance Cs. The first capacitance Cp is connected in parallel with the first inductance Lp. The series network (Ls and Cs) is then connected across the parallel network (Lp and Cp). The values of the inductances Lp, Ls and the capacitances Cp, Cs are selected so that the resonant circuit 10 as configured in FIG. 1 resonates at an initial or first resonant frequency within a first resonant frequency range which is outside of the frequency range of an electronic article surveillance (EAS) system with which a tag incorporating the resonant circuit 10 may be used. Preferably, the frequency of the resonant circuit 10 as shown in FIG. 1 is above or higher than the detection frequency range of the EAS system. Methods for selecting the values of the inductances and the capacitances to meet the frequency requirements of the resonant circuit 10 are well known to those of ordinary skill in the art and need not be described herein for a complete understanding of the present invention. The capacitances can be lumped or distributed within the inductances as will hereinafter be described. Because the resonant circuit 10 resonates at a frequency which is outside of the detection frequency range of the EAS system, the resonant circuit 10 is effectively in an inactive state.

Activation of the resonant circuit 10 is accomplished by creating a short circuit condition which effectively removes the first inductance Lp from the resonant circuit 10. Many different methods known to those of ordinary skill in the art may be employed for creating such a short circuit (referred to as a deactivation feature). Accordingly, the precise method used for creating such a short circuit in the present embodiment should not be taken as a limitation upon the present invention. In the present embodiment, the breakdown voltage across the plates of the first capacitor Cp is lower than the breakdown voltage across the plates of the second capacitor Cs, to create a weakened area so that the first capacitor Cp shorts out before the second capacitor Cs. Creating such a lower breakdown voltage may be accomplished in many ways, including weakening the dielectric between the plates of the first capacitor Cp, placing all or a portion of the plates of the first capacitor Cp closer together, creating a link between the plates of the first capacitor Cp or employing any other technique known to those of ordinary skill in the art. Alternatively, the values for the first capacitance Cp and the second capacitance Cs may be selected such that when the circuit 10 is resonating at the first frequency, the voltage across the first capacitor Cp is significantly higher than the voltage across the second capacitor Cs, such that the first capacitor Cp always short circuits before the second capacitor Cs without having to physical alter the first capacitor Cs.

Regardless of the particular method employed for creating a short circuit, when the resonant circuit 10 as shown in FIG. 1 is exposed to electromagnetic energy at the first or activation frequency with a minimum power level which is high enough to cause the first capacitor Cp to short circuit, the effect is to short circuit the first inductance Lp and to thereby, effectively remove the first inductance Lp (and of course, the first capacitance Cp) from the resonant circuit. The removal of the first inductance Lp, (and the first capacitance Cp) effectively changes the resonant circuit to one which includes only the second inductance Ls and the second capacitance Cs. The values of the second inductance Ls and the second capacitance Cs are selected so that the resulting circuit resonates at a second frequency, which is in a second frequency range, i.e., the detection frequency range of the EAS system with which the resonant circuit is to be used. In the second state, the resonant circuit 10 is said to be "active" so that the resonant circuit 10 is detectable by the EAS system and may be then be used for security purposes.

Deactivation of the resonant circuit 10 is accomplish by exposing the resonant circuit 10, when in the active state as described above, to electromagnetic energy at the second resonant frequency of the circuit 10 at a predetermined minimum power level, which is high enough to short circuit the second capacitance Cs, and thereby, effectively short circuit the second inductance Ls. The short circuiting of the second inductance Ls, either changes the resonant frequency of the circuit 10 to a third frequency which is within a third frequency range outside of the detection frequency range of the EAS system, decreases the "Q" of the circuit 10 so it is no longer detectable by an EAS system, or prevents the circuit 10 from resonating at all. In any event, the circuit 10 is effectively deactivated because the circuit no longer functions with the EAS system. Thus, the resonant circuit 10, as shown in FIG. 1 is both activatable and deactivatable.

Activatable/deactivatable resonant circuits and security tags implementing such activatable/deactivatable resonant circuits for use in EAS systems are known in the prior art as evidenced by U.S. Pat. Nos. 5,081,445 and 5,103,210. The present resonant circuit 10, when implemented in a security tag, overcomes the above-described electrostatic discharge problems associated with the security tags of the '445 and '210 patents by providing a direct electrical connection between the conductive patterns of the security tag as will hereinafter be described in greater detail.

Figure 2:
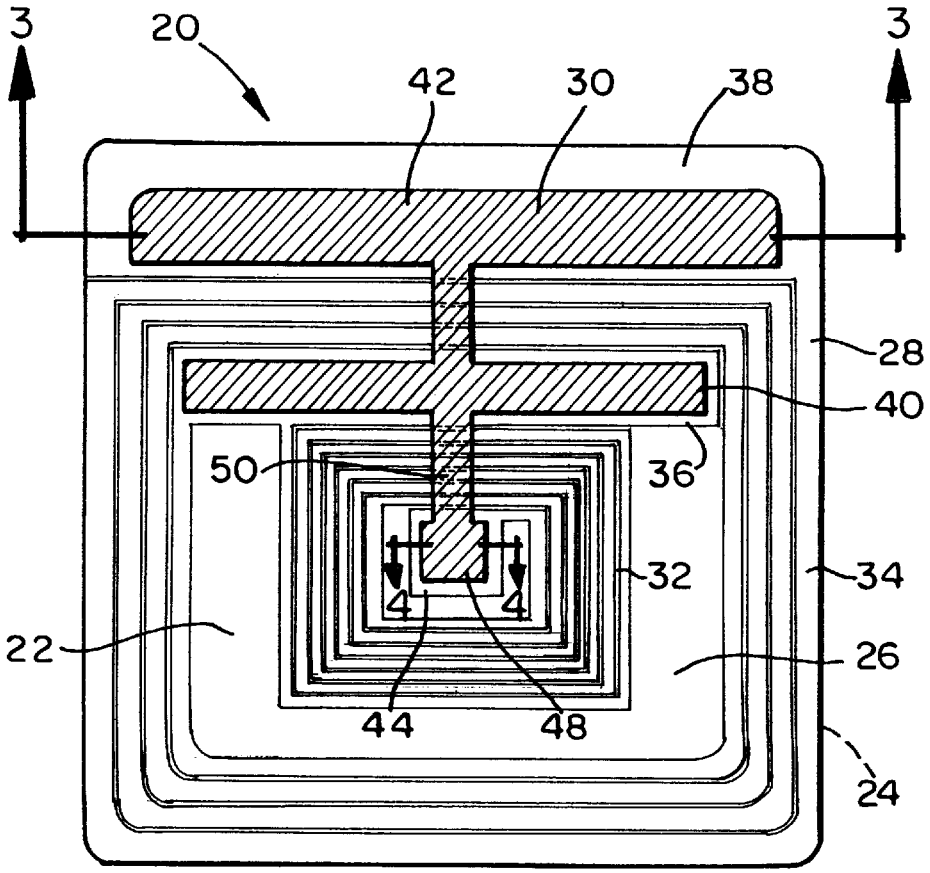
FIG. 2 is a top plan view of a first preferred embodiment of a printed circuit security tag in accordance with the schematic of FIG. 1.
Figure 3:
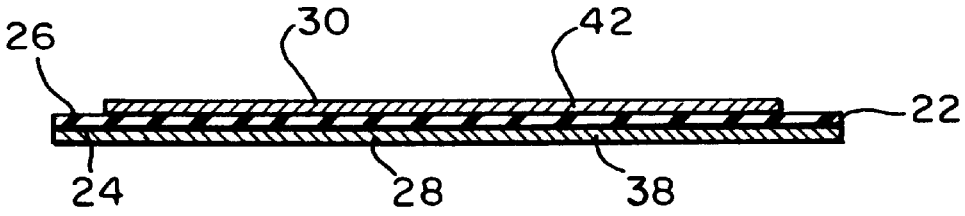
FIG. 3 is a cross sectional view of a portion of the tag taken along line 3—3 of FIG. 2.
Figure 4:
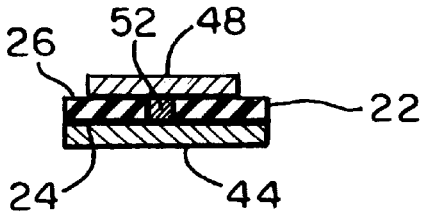
FIG. 4 is a cross sectional view of a portion of the tag taken along line 4—4 of FIG. 2.

FIG. 2 is a top plan view of a security tag 20 in accordance with a first implementation or embodiment of the resonant circuit 10 shown in FIG. 1. The security tag 20 as shown in FIGS. 2–4 is comprised of a substantial planar dielectric substrate 22 having a first principal surface or side 24 and a second, opposite principal surface or side 26. The substrate 22 may be constructed of any solid material or composite structure or other materials as long as the substrate is insulative, relatively thin and can be used as a dielectric. Preferably, the substrate 22 is formed of an insulated dielectric material, for example, a polymeric material such as polyethylene. However, it will be recognized by those skilled in the art that other dielectric materials may alternatively be employed in forming the substrate 22. As illustrated in FIG. 2, the substrate 22 is transparent. However, transparency is not a required characteristic of the substrate 22.

The circuit components of the resonant circuit 10 as previously described are formed on both principal surfaces or sides 24, 26 of the substrate 22 by patterning a conductive material. That is, a first conductive pattern 28 (shown in the lighter color of FIG. 2) is formed on the first side 24 of the substrate 22 which is arbitrarily illustrated in FIG. 2 as the bottom or backside of the tag 10. A second conductive pattern 30 (shown in the darker color on FIG. 2) is formed on the second side 26 of the substrate 22. The conductive patterns 28, 30 may be formed on the substrate surfaces 24, 26, respectively with electrically conductive materials of a known type and in a manner which is well known to those of skill in the electronic article surveillance art. Preferably, the conductive material is patterned by a subtractive process (i.e., etching) whereby unwanted material is removed by chemical attack after the desired material has been protected, typically with a printed on etch resistant ink. In the preferred embodiment, the conductive material is aluminum. However, other conductive materials (e.g., gold, nickel, copper, bronzes, brass, high density graphite, silver-filled conductive epoxies or the like) can be substituted for the aluminum without changing the nature of the resonant circuit 10 or its operation. Similarly, other methods (die cutting or the like) may be employed for forming the conductive patterns 28, 30 on the substrate 22. The tag 10 may be manufactured by a process of the type described in U.S. Pat. No. 3,913,219, entitled "Planar Circuit Fabrication Process" which is incorporated herein by reference. However, other manufacturing processes can be used if desired.

As previously stated, the first and second conductive patterns 28, 30 together form the resonant circuit 10 as discussed above. In the embodiment as shown in FIG. 2, both of the inductances or inductive elements Lp and Ls are provided in the form of conductive coils 32, 34 respectively, both of which are a part of the first conductive pattern 28. Accordingly, both of the inductances Lp and Ls are located on the first side 24 of the substrate 22. Preferably, the two conductive coils 32, 34 are wound in opposite directions relative to current flow, as shown, to maximize coupling to the activation field. In addition, the first plates 36, 38 of each of the capacitive elements or capacitances Cp and Cs are formed as part of the first conductive pattern 28 on the first side 24 of the substrate 22. Finally, the second plates 40, 42 of each of the capacitances Cp and Cs are formed as part of the second conductive pattern 30 and are located on the second side 26 of the substrate 22.

As discussed briefly above, in the security tag 20 a direct electrical connection extends through the substrate 22 to electrically connect the first conductive pattern 28 to the second conductive pattern 30 to thereby continuously maintain both sides of the substrate 22 at substantially the same static charge level. Referring to FIGS. 2 and 4, the first conductive pattern 28 includes a generally square land 44 on the inner most end of the coil portion 32, which forms the first inductance Lp. Likewise, a generally square land 48 is formed as part of the second conductive pattern 30 and is connected by a conductive beam 50 to the portion of the second conductive pattern 30, which forms the second plate 40 of the first capacitance Cp. As shown in FIGS. 2 and 4, the conductive lands 44, 48 are aligned with each other. The direct electrical connection is made by a weld through connection 52, which extends between conductive land 44 of the first conductive pattern 28 and conductive land 48 of the second conductive pattern 30 as best shown in FIG. 4. Preferably, the direct electrical connection 52 between the lands 44, 48 is formed by a weld in a manner which is well known to those of ordinary skill in the EAS art. Referring to the schematic of FIG. 1, the weld or direct electrical connection 52 is schematically positioned at the location of reference letter A. Because the weld or direct electrical connection 52 provides a permanent positive, low resistance electrical connection between the first and second sides 24, 26 of the substrate 22, as well as between the first and second conductive patterns 28, 30, any static charge which is present is maintained at the same static charge level on both sides of the substrate 22. Thus, any potential abrupt change in the static charge level of one side of the substrate 22, for example, by touching one side of the substrate 22 to ground, results in the same static charge level on the other side of the substrate 22. In this manner, a difference in the voltage potential between the two side of the substrate 22 is avoided to thereby avoid premature short circuiting of either of the capacitances Cp, Cs to thereby avoid short circuiting of either of the inductances Lp, Ls.

Figure 5:
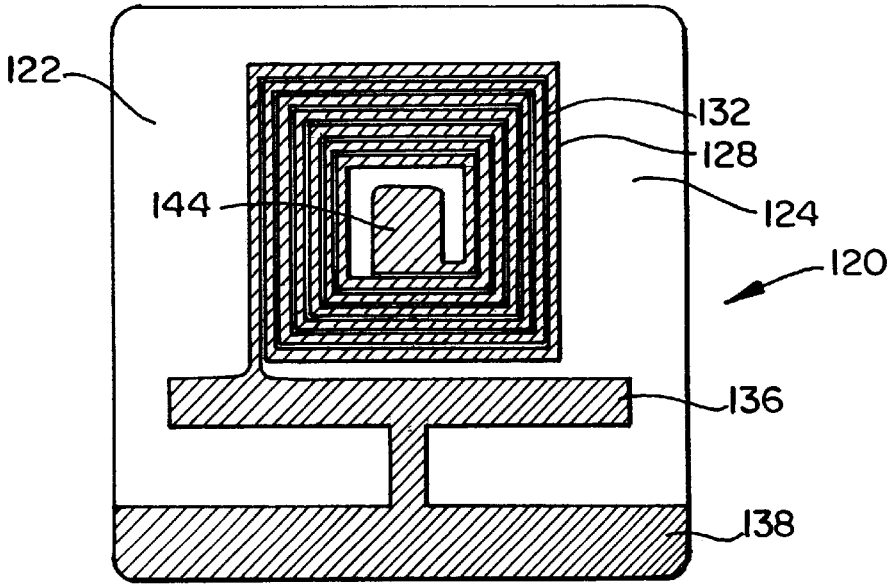
FIG. 5 is a top plan view of a second preferred embodiment of a security tag in accordance with the schematic of FIG. 1.
Figure 6:
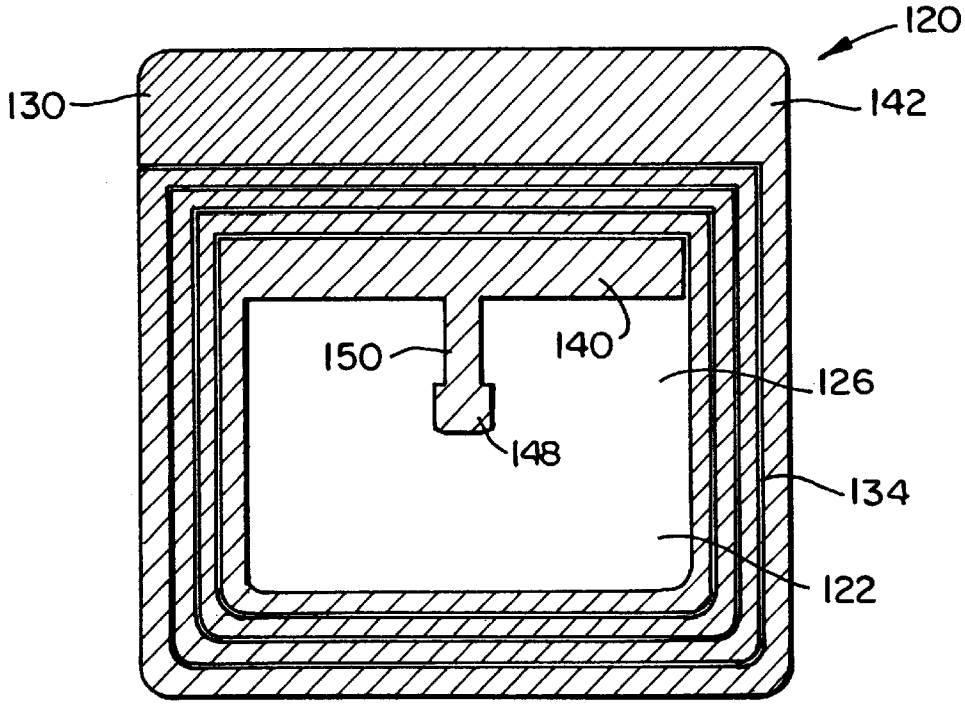
FIG. 6 is a bottom plan view of the security tag of FIG. 5.

A second implementation or embodiment of a security tag 120 in accordance with the resonant circuit 10 is illustrated in FIGS. 5 and 6. As with the first embodiment, the security tag 120 is comprised of a substantially planar dielectric substrate 122 having a first principal surface or side 124 and a second opposite principal surface or side 126. Preferably, the substrate 122 is formed of the same material as described above in connection with the first embodiment.

As with the first embodiment, the circuit components of the resonant circuit 10 are formed on both principal surfaces 124, 126 of the substrate 122 by patterning a conductive material in the same manner as described above in connection with the first embodiment. Thus, a first conductive pattern 128 is formed on the first side 124 of the substrate as illustrated in FIG. 5 and a second conductive pattern 130 is formed on the second side of the 126 of the substrate 122 as illustrated in FIG. 6. This first and second conductive patterns 128, 130 together form the resonant circuit 10 a discussed above. In the present embodiment, the first inductance or inductive element Lp is provided in the form of a conductive coil 132 which is part of the first conductive pattern 128 and thus, is located on the first side 124 of the substrate 122. The second inductance or inductive element Ls is provided in the form of a conductive coil 134 which is part of the second conductive pattern 130 located on the second side 126 of the substrate 122. Preferably, the two conductive coils 132, 134 are wound in opposite directions relative to current flow to maximize coupling to the activation field. As with the first embodiment, the first plates 136, 138 of the capacitive elements or the capacitances Cp and Cs are formed as part of the first conductive pattern 128 on the first side 124 of the substrate 122. Finally, the second plates 140, 142 of each of the capacitances Cp and Cs are formed as part of the second conductive pattern 130 on the second side 126 of the substrate 122.

The first conductive pattern 128 further includes a generally square land 144 on the innermost end of the coil portion 132 which forms the first inductance Lp. Likewise, a generally square land 148 is formed as part of the second conductive pattern 130 and is connected by a conductive beam 150 to the second plate 140 of the first capacitance Cp. As with the first embodiment, a direct electrical connection is made by a weld through connection, which extends between conductive land 144 of the first conductive pattern 128 and conductive land 148 of the second conductive pattern 130. Referring to the schematic of FIG. 1, the weld or the direct electrical connection is schematically positioned at the location of reference letter B. The security tag 120 as shown in FIGS. 5 and 6 functions in the same manner as described above in connection with the security tag 20 of FIGS. 2–4.

Figure 7:
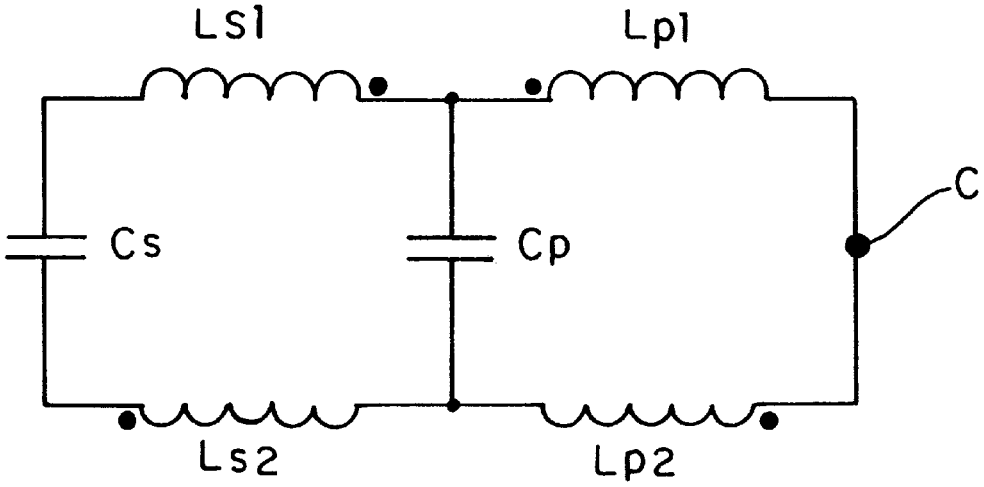
FIG. 7 is an electrical schematic of a resonant circuit in accordance with a third preferred embodiment of the present invention.
Figure 8:
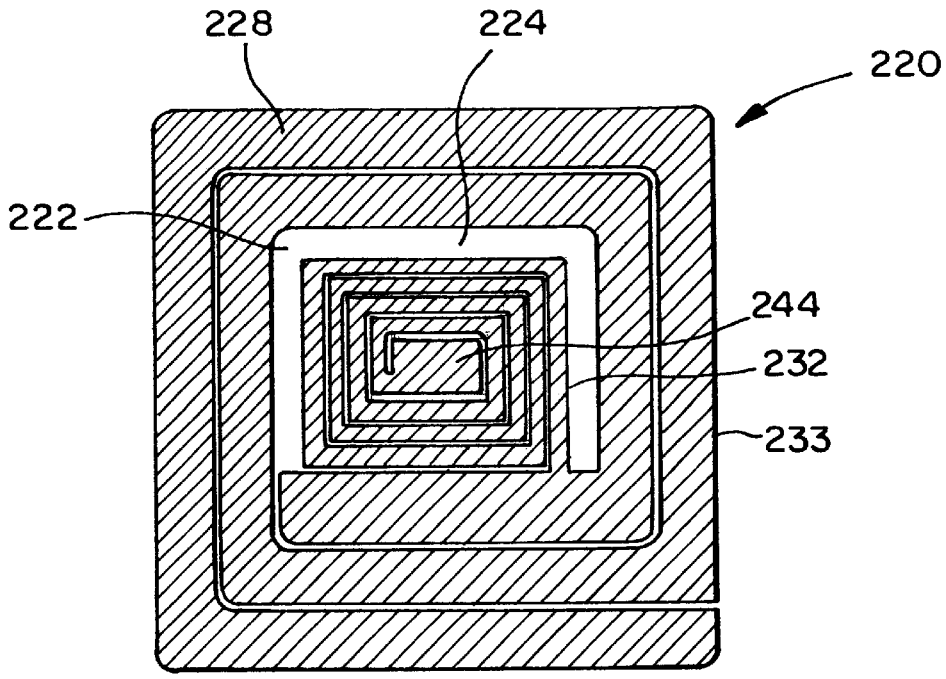
FIG. 8 is a top plan view of a third preferred embodiment of a security tag in accordance with the schematic of FIG. 7.
Figure 9:
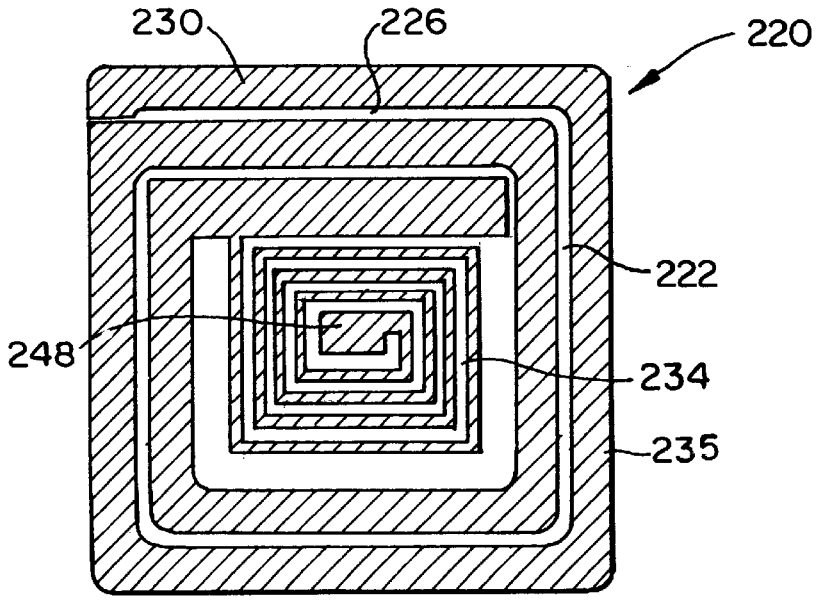
FIG. 9 is a bottom plan view of the tag of FIG. 8.

FIGS. 8 and 9 illustrate a third implementation or embodiment of a security tag 220 in accordance with the present invention. The security tag 220 of FIGS. 8 and 9 is similar to the security tag 120 of FIGS. 5 and 6. However, in the security tag 220 of FIGS. 8 and 9, the inductances or inductive elements Lp and Ls are split so that each such inductance is located on each side of the substrate as will hereinafter be described. A schematic representation of the security tag 220 is illustrated in FIG. 7. As shown in FIG. 7, the first inductance is split into two separate inductances schematically illustrated as Lp1 and Lp2. Likewise, the second inductance is split into two separate inductances Ls1 and Ls2. Inductances Lp1 and Lp2 are mutually coupled as are inductances Ls1 and Ls2.

As with the above-described embodiments, the security tag 220 as shown in FIGS. 8 and 9 is comprised of a substantially planar dielectric substrate 222 having a first principal surface 224 and a second principal surface 226. The substrate 222 is preferably formed in a manner as described above. As with the above-described embodiments, the circuit components of the resonant circuit schematically illustrated in FIG. 7 are formed on both principal surfaces 224, 226 of the substrate 222 by patterning a conductive material in the manner described above. That is, a first conductive pattern 228, shown on FIG. 8, is formed on the first side 224 of the substrate. Likewise, a second conductive pattern 230 shown in FIG. 9 is formed on the second side 226 of the substrate 222. The first and second conductive patterns 228, 230 together form the resonant circuit as shown in FIG. 7 and as discussed detail above. As illustrated in FIG. 8, inductive element Lp2 is provided in the form of a first conductive coil 232 and inductance Ls2 is provided in the form of a second conductive coil 233, both of which are part of the first conductive pattern 228. Similarly, as shown in FIG. 9, inductance Lp1 is formed as a third conductive coil 134 and inductance Ls1 is formed as a fourth conductive coil 135, both of which are part of the second conductive pattern 230. Preferably, the first and second conductive coils 232, 233 are wound in opposite directions and the third and fourth conductive coils 234, 235 are wound in opposite directions relative to current flow to maximize coupling to the activation field. In the security tag 220 as illustrated in FIGS. 8 and 9, the capacitances Cp and Cs are actually distributed capacitances which are implemented by the conductive pattern portions which form the conductive coils 232, 233, 234 and 235 in a manner well known to those of ordinary skill in the art.

As with the above-described security tags, the security tag 220 of FIGS. 8 and 9 include a direct electrical connection, which extends through the substrate 222 to electrically connect the first conductive pattern 228 to the second conductive pattern 230 to thereby maintain both sides of the substrate 222 at substantially the same static charge level. For this purpose, the first conductive pattern 228 includes a generally rectangular land 244 on the inner most end of the first coil portion 232 which forms inductance Lp2. Similarly, the second conductive pattern 228 includes a generally rectangular land 248 on the inner most end of the coil portion 234 which form the inductance Lp1. The conductive lands 244 and 248 are aligned with each other and the direct connection is made by a weld through connection which extends between the conductive lands 244, 248 in a manner as described above in connection with the first embodiment. Referring to the schematic of FIG. 7, the weld or direct electrical connection is schematically positioned at the location of reference letter C. The security tag 220 of FIGS. 8 and 9 functions in the same manner as described above in connection with security tag 20.

From the foregoing description, it can be seen that the present invention comprises an activatable/deactivatable security tag, which includes electrostatic protection for preventing premature activation or deactivation of the security tag. It will be appreciated by those skilled in the art that changes may be made to the above-described embodiment of the invention without departing from the broad inventive concepts thereof. For example, the same inventive concepts could be employed in connection with activatable/deactivatable security tags having additional capacitors, additional inductances or both. It is understood, therefore, that this invention is not limited to the particular embodiments disclosed, but is intended to cover any modifications which are within the scope and spirit of the invention as defined by the appended claims.

What is claimed is:

1. A security tag for use with an electronic security system which functions within a second frequency range, the tag comprising:

a substantially planar dielectric substrate having a first side and a second side;

a first conductive pattern on the first side of the substrate, the first conductive pattern comprising at least a first inductive element, a second inductive element, a first plate of a first capacitive element, and a first plate of a second capacitive element;

a second conductive pattern on the second side of the substrate, the second conductive pattern comprising, at least a second plate of the first capacitive element and a second plate of the second capacitive element, the plates of each of the capacitive elements being generally aligned, the inductive elements and the capacitive elements forming a resonant circuit, which resonates at a first frequency within a first frequency range which is outside of the second frequency range;

a direct electrical connection extending through the substrate to electrically connect the first conductive pattern to the second conductive pattern to thereby continuously maintain both sides of the substrate at substantially the same static charge level, wherein the first capacitive element includes an activation feature for short circuiting the first capacitive element when the resonant circuit is exposed to electromagnetic energy within the first frequency range of at least a predetermined minimum power level to short circuit the first inductive element and thereby change the resonant frequency of the resonant circuit to a second frequency within the second frequency range.

2. The security tag as recited in claim 1, wherein the second capacitive element includes a deactivation feature for short circuiting the second capacitive element when the resonant circuit is exposed to electromagnetic energy within the second frequency range of at least a predetermined minimum power level to short circuit the second inductive element and thereby prevent the circuit from resonating or change the resonant frequency of the resonant circuit to a third frequency within a third frequency range which is outside of the second frequency range.

3. The security tag as recited in claim 1, wherein the direct electrical connection extends between the first inductive element and the second plate of the first capacitive element.

4. The security tag as recited in claim 1, when the first and second inductive elements are wound in opposite directions.

5. A security tag for use with an electronic security system, which functions within a second frequency range, the tag comprising:

a substantially planar dielectric substrate having a first side and a second side;

a first conductive pattern on the first side of the substrate, the first conductive pattern comprising at least a first inductive element, a first plate of a first capacitive element, and a first plate of a second capacitive element;

a second conductive pattern on the second side of the substrate, the second conductive pattern comprising at least a second inductive element, a second plate of the first capacitive element, and a second plate of the second capacitive element, the plates of each of the capacitive elements being generally aligned, the inductive elements and the capacitive elements forming a resonant circuit which resonates at a first frequency within a first frequency range which is outside of the second frequency range; and a direct electrical connection extending through the substrate to electrically connect the first conductive pattern to the second conductive pattern to thereby continuously maintain both sides of the substrate at substantially the same static charge level, wherein the first capacitive element includes a deactivation feature for short circuiting the first capacitive element when the resonant circuit is exposed to electromagnetic energy within the first frequency range of at least a predetermined minimum power level to short circuit the first inductive element and thereby change the resonant frequency of the resonant circuit to a second frequency within the second frequency range.

6. The security tag as recited in claim 5, wherein the second capacitive element includes a deactivation feature for short circuiting the second capacitive element when the resonant circuit is exposed to electromagnetic energy within the second frequency range of at least a predetermined minimum power level to short circuit the second inductive element and thereby prevent the circuit from resonating or change the resonant frequency of the resonant circuit to a third frequency within a third frequency range which is outside of the second frequency range.

7. The security tag as recited in claim 5, wherein the direct electrical connection extends between the first inductive element and the second plate of the first capacitive element.

8. The security tag as recited in claim 5, when the first and second inductive elements are wound in opposite directions.

9. A security tag for use with an electronic security system which functions within a second frequency range, the tag comprising:

a substantially planar dielectric substrate having a first side and a second side;

a first conductive pattern on the first side of the substrate, the first conductive pattern comprising at least a first inductive element, a second inductive element, a first plate of a first capacitive element, and a first plate of a second capacitive element;

a second conductive pattern on the second side of the substrate, the second conductive pattern comprising at least a third inductive element, a fourth inductive element, a second plate of the first capacitive element, and a second plate of the second capacitive element, the plates of each of the capacitive elements being generally aligned, the inductive elements and the capacitive elements forming a resonant circuit which resonates at a first frequency within a first frequency range which is outside of the second frequency range; and a direct electrical connection extending through the substrate to electrically connect the first conductive pattern to the second conductive pattern to thereby continuously maintain both sides of the substrate at substantially the same static charge level, wherein the first capacitive element includes a deactivation feature for short circuiting the first capacitive element when the resonant circuit is exposed to electromagnetic energy within the first frequency range of at least a predetermined minimum power level to short circuit the first and third inductive elements and thereby change the resonant frequency of the resonant circuit to a second frequency within the second frequency range.

10. The security tag as recited in claim 9, wherein the second capacitive element includes a deactivation feature for short circuiting the second capacitive element when the resonant circuit is exposed to electromagnetic energy within the second frequency range of at least a predetermined minimum power level to short circuit the second and fourth inductive elements and thereby prevent the circuit from resonating or change the resonant frequency of the resonant circuit to a third frequency within a third frequency range which is outside of the second frequency range.

11. The security tag as recited in claim 9, wherein the direct electrical connection extends between the first inductive element and the third inductive element.

12. The security tag as recited in claim 9, wherein the first and third inductive elements are wound in opposite directions.

* * * * *